United States Patent [19]

Hupp

[11] 4,397,217

[45] Aug. 9, 1983

[54] RECOIL AND COUNTER RECOIL MECHANISM FOR A FIREARM

[75] Inventor: Gerhard Hupp, Oberndorf, Fed. Rep. of Germany

[73] Assignee: Mauser-Werke Oberndorf GmbH, Fed. Rep. of Germany

[21] Appl. No.: 197,121

[22] Filed: Oct. 15, 1980

[30] Foreign Application Priority Data

Nov. 7, 1979 [DE] Fed. Rep. of Germany ..... 2944859

[51] Int. Cl.[3] ..... F41F 19/06

[52] U.S. Cl. ..... 89/177

[58] Field of Search ..... 89/177, 178, 198; 42/75 B

[56] References Cited

U.S. PATENT DOCUMENTS

| | | | |
|---|---|---|---|
| 2,539,275 | 1/1951 | Sahlin et al. | 89/198 |
| 2,982,183 | 5/1961 | Colby | 89/177 |

FOREIGN PATENT DOCUMENTS

| | | |
|---|---|---|
| 716385 | 1/1942 | Fed. Rep. of Germany . |
| 2208130 | 9/1972 | Fed. Rep. of Germany . |
| 2417333 | 11/1974 | Fed. Rep. of Germany . |
| 2408446 | 8/1975 | Fed. Rep. of Germany . |
| 2655708 | 6/1978 | Fed. Rep. of Germany . |

*Primary Examiner*—Stephen C. Bentley

*Attorney, Agent, or Firm*—McGlew and Tuttle

[57] ABSTRACT

A recoil and counter recoil device for a firearm which can fire a plurality of shots in succession comprises a recoil spring bearing against a barrel and a receiver which receives the barrel for motion in a recoil and counter recoil direction and an annular spring which is axially deformable to exert a load connected between the barrel and the receiver to counteract the action of the recoil spring in the counter recoil direction to cause the barrel to float in a confined motion in the recoil and counter recoil directions during successive firing of the firearm.

6 Claims, 7 Drawing Figures

III
III
R
V
R

RECOIL AND COUNTER RECOIL MECHANISM FOR A FIREARM

FIELD AND BACKGROUND OF THE INVENTION

The invention relates in general to firearms and, in particular, to a new and useful recoil and counter recoil mechanism for a firearm.

Such a mechanism is disclosed in German AS No. 2,208,130. This prior art design is intended to reduce the recoil of a barrel, to increase the rate of fire of the firearm. This weapon is fired only with the barrel in a rest position. A friction brake is provided to be effective only during the recoil motion. The spring element counteracts the recoil spring. It can damp the counter recoil motion of the barrel, however, a substantial braking of the barrel in counter recoil motion is not possible since stiffening of the spring element would require a corresponding stiffening of the recoil spring. The mechanism according to this reference is neither suitable nor intended for an advanced ignition.

German OS No. 2,408,446 discloses a firearm comprising two spring elements which are coaxial with the barrel. The barrel forms a constructional unit with the breech block and the cartridge chamber. A sort of "floating" mounting of the barrel and breech system is obtained in this design. One of the damping springs of the mechanism becomes effective at the first discharge of a burst of fire. During the burst of fire, the recoil spring becomes more and more tensioned. After a few shots, an abutment is reached. An advanced ignition to the effect that each shot is fired during the counter recoil motion is not obtained.

German Pat. No. 2,417,333 discloses a design in which a receiver and a barrel are separately mounted for recoil motion relative to the mount. The purpose is to prevent the receiver from being exposed to bending moments caused by the recoil of the barrel.

There are known weapons mounted in a floating manner to obtain the effect that everyone of a series of shots is fired during the counter recoil motion of the barrel. In such weapons however, a hydraulic device is provided causing bending moments which are effective transversely to the firing direction, so that oscillations of the barrel must be expected, unfavorably affecting the accuracy of fire. Further, a connection between the weapon and the recoil mechanism is needed in addition to the mounting of the barrel.

SUMMARY OF THE INVENTION

The present invention is directed to a mechanism of the above-mentioned kind which permits an advanced ignition without adversely affecting the accuracy of fire by the occurrance of bending moments, and which permits the coupling of the barrel, the breech, and the recoil mechanism to each other in a simple way.

An object of the present invention is to provide a recoil and counter recoil device for a firearm which can fire a plurality of shots in succession, to produce a recoil motion, the firearm having a barrel movable in a recoil and counter recoil direction in a receiver and a breech movable with and with respect to the barrel, comprising, a recoil spring coaxial with the barrel bearing between the barrel and the receiver for absorbing motion of the barrel in the recoil direction and then moving the barrel in the counter recoil direction, an annular spring axially fixed to the barrel and radially movable to absorb a load, and the receiver having a tapered surface portion over which the annular spring is movable when the barrel moves in the counter recoil direction to counteract the action of the recoil spring.

The annular spring is taken along by the barrel in both the counter recoil and the recoil directions. During the recoil motion the annular spring expands while passing along the tapered portion, without substantially loading the recoil spring. During the counter recoil motion, the annular spring is tensioned, so that the counter recoil motion of the barrel is strongly braked. No bending moments are thereby caused which would unfavorably affect the accuracy of fire, since the spring is coaxial with the barrel. Due to the braking, an advance ignition to the effect that every shot of a burst is fired during the counter recoil motion, is possible even with varying intervals between the individual shots which may be caused, for example, by temperature variations alone. Because of the interlocking between the breech and the barrel, the final counter recoil motion, which is braked by the annular spring, is delayed by the occurring acceleration of the breech block. Further, this interlocking makes it easy to exchange the barrel and to couple it both to the receiver and breech.

In a preferred embodiment of the invention, the tapered portion extends over a part of the recoil range, particularly in the end zone thereof. The start of the action of the annular spring can thus be predetermined as required.

Preferably, the annular spring is provided between the recoil spring and the bushing which is axially displacable within the receiver and locked to the barrel at least during the recoil motion. Therefore, any particular means for guiding the annular spring are unnecessary.

A further object of the invention is to provide a recoil and counter recoil device for a firearm which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figures 1, 2, 3, 4:
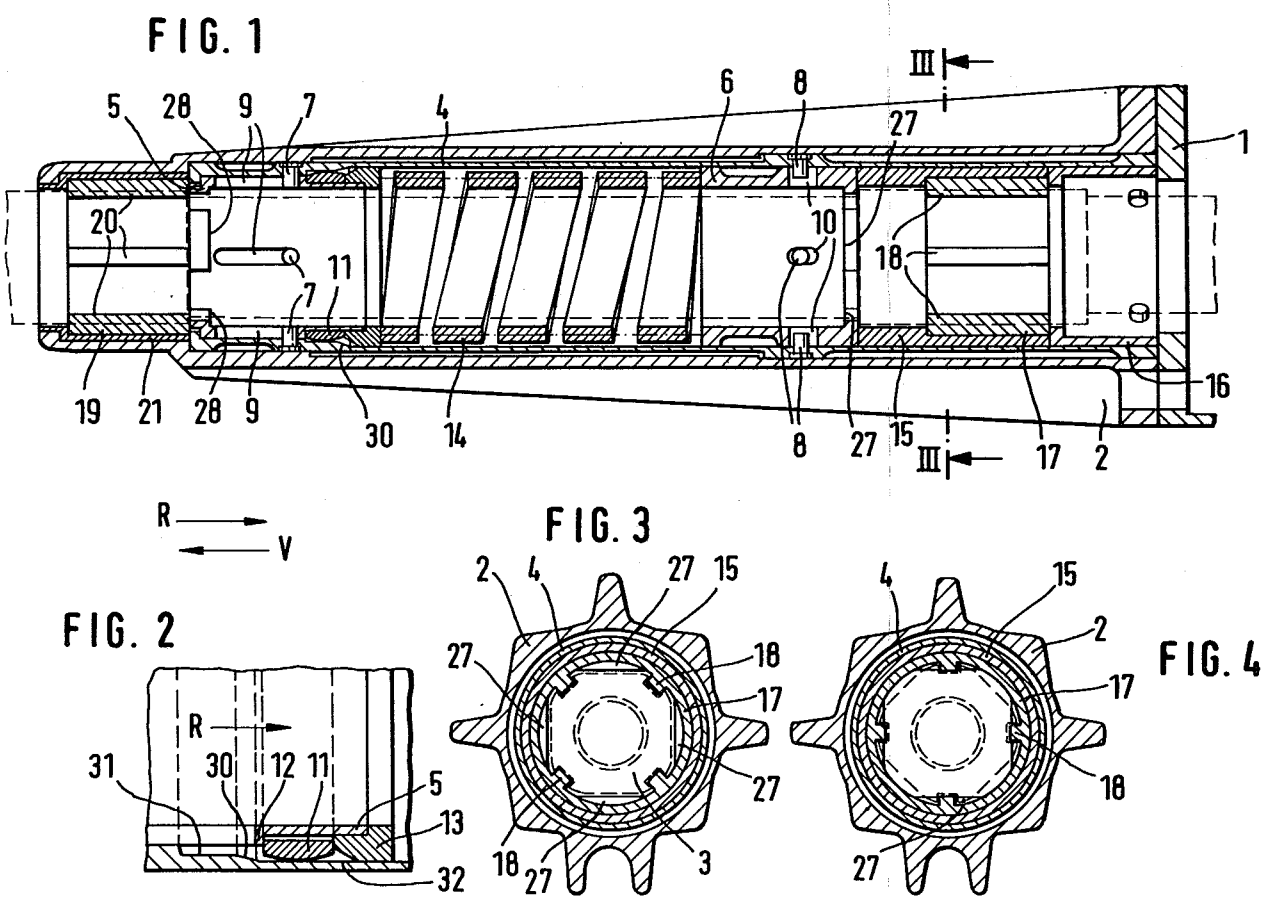
FIG. 1 is a sectional view of a recoil and counter recoil mechanism of a firearm according to the invention.
FIG. 2 is an enlarged partial view corresponding to FIG. 1, of the annular ring area.
FIG. 3 is a sectional view taken along the line III—III of FIG. 1, with the barrel unlocked.
FIG. 4 is a view similar to FIG. 3 with the barrel locked.

Turning to the drawings in particular, the invention embodied therein, in FIG. 1, comprises a recoil and counter recoil device for a firearm which can fire a plurality of shots in succession, the firearm having a barrel movable in a recoil and counter recoil direction in a receiver.

Figure 5:
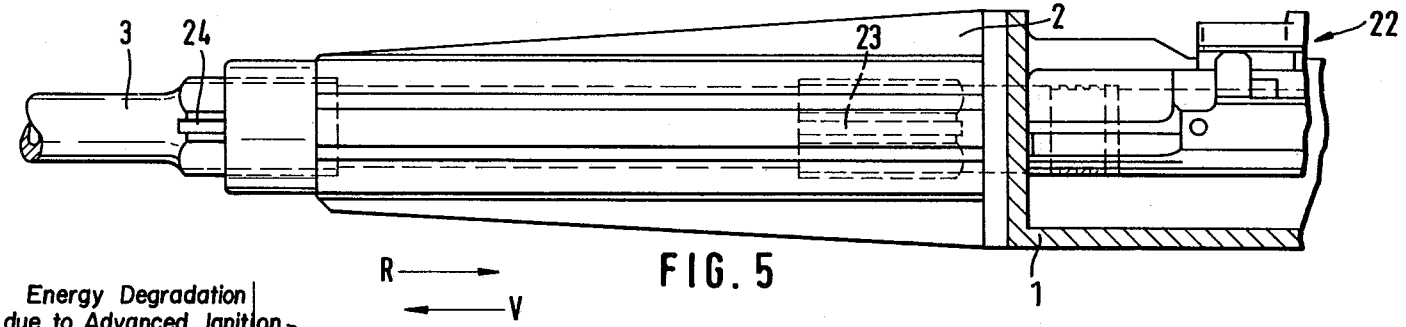
FIG. 5 is an elevational view corresponding to FIG. 1 also showing a breech block assembly but on a reduced scale.

The receiver 2 is secured to a mount or cradle 1 of the firearm and extends about ⅓ of the total length of the barrel 3. (see FIG. 5). An inner sleeve 4 is inserted in the interior of receiver 2 and fixed therein. Mounted in inner sleeve 4 is a front stop bushing 5 and a rear stop bushing 6. Inner sleeve 4 is provided with studs 7, 8 projecting into slots 9 of front bushing 5 and slots 10 of rear bushing 6, respectively.

Front stop bushing 5 is embraced by an annular spring 11 which is split at a location on its circumference. The annular spring is placed between a shoulder 12 of front stop bushing 5 and a retaining ring 13 secured to this bushing. A helical spring 14 or a friction ring spring is received between retaining ring 13 and rear stop bushing 6. Rear stop bushing 6 is backed by an insert bushing 15 which in turn is arrested by another insert bushing 16. Insert bushing 15 accommodates a slide bushing 17 which is provided with guide ribs 18 on its inner circumference. An identical slide bushing 19 with guide ribs 20 is mounted in receiver 2 at the front side of front stop bushing 5, by means of a slide guide 21. Slide bushing 17 and 19 are rotatable in receiver 2.

As may be learned from FIG. 1, these parts can easily be inserted into receiver 2 prior to its securing to mount 1, from the right side of receiver 2.

Figure 6:
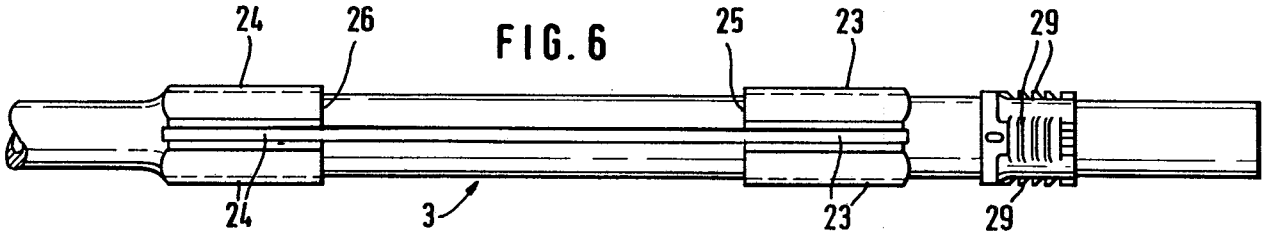
FIG. 6 shows a barrel for the design according to FIGS. 1 to 5.

On the mount 1, a breech assembly 22 known per se is mounted for free displacement. The breech assembly comprises a moving breech block and a usual buffer spring (not shown). Barrel 3 (see FIG. 6) is provided with rear guide grooves 23 corresponding to guide ribs 18, and front guide grooves 24 corresponding to guide ribs 20. Between guide grooves 23 or 24, stop surfaces 25,26 are formed which are associated with corresponding projections 27,28 of rear stop bushing 6 and front stop bushing 5. In addition, barrel 3 is provided with circumferentially distributed locking lugs 29 by means of which it can be locked to the breech 22.

In this design, barrel 3 has a shape which is immune to damage during transportation and to thermal stresses. The barrel (see FIG. 6) can be inserted into receiver 2 (see FIG. 1), in a simple way. For this purpose it is slipped from the front side into the receiver. Guide grooves 23,24 slide on guide ribs 18 and 20 of bushings 17, 19 (see FIG. 3). Upon insertion, the barrel is turned through 45° for example, and slide bushings 17 and 19 turn along through this angle. Due to this angular displacement, stop surfaces 25, 26 come into positions in front of projections 27, 28 so that projections 27 prevent the barrel from being withdrawn, and projections 28 prevent a further displacement of the barrel inwardly (see FIG. 4). At the same time locking lugs 29 engage the breech which thereby becomes axially rigidly connected to the barrel.

In the zone of annular spring 11, inner sleeve 4 is provided with a tapered portion 30 (see FIG. 2). This tapered portion 30 extends adjacent an annular surface 31 of smaller diameter, and an annular surface 32 of larger diameter. Annular spring 11 is shaped on its outer circumference for sliding along the tapered portion as the barrel is displaced in its axial direction. Unlike FIG. 1, FIG. 2 shows annular spring 11 as applied to annular surface 32 of larger diameter. In this position, spring 11 is expanded, while on annular surface 31 it would be compressed. In FIG. 2 annular spring 11 is shown approximately in a position reached at the instant at which helical spring or friction ring spring 14 is tensioned to reverse the motion of barrel 3 to counter recoil. Tapered portion or annular surface 30 is provided about intermediate this position and the rest position of the barrel shown in FIG. 1.

Figure 7:
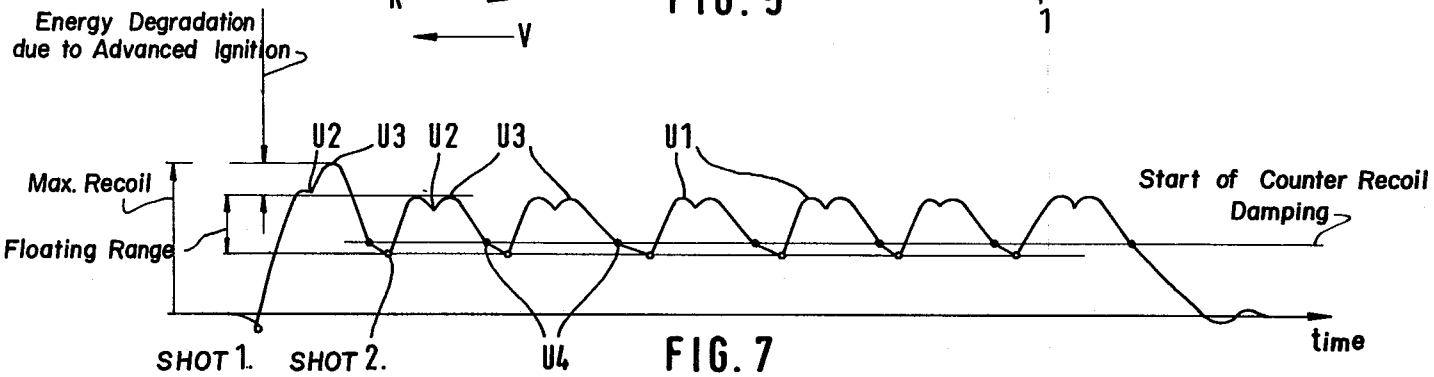
FIG. 7 is a time diagram of a burst of fire, showing the movement of the barrel.

FIG. 7 is a time-traverse diagram of the barrel motion during a burst of fire. Reference characters U1 to U4 designate the characteristic points of the diagram. Upon a first discharge, the recoil motion is shortened due to the energy degradation upon an advanced ignition. At the following discharges, the barrel moves within the floating range. In counter recoil motion, the counter recoil damping sets in under the action of annular spring 11.

The inventive mechanism substantially operates as follows:

While locking barrel 3 in the described way by its stop surfaces 25 and 26 and projections 27, 28, to receiver 2, its connection to breech 22 is established at the same time. Now, upon the discharge of a first shot, the barrel recoils in the direction of arrow R. The barrel 3, by its stop surface 26, drives bushing 5 by its projection 28 so that the annular spring 11 is also moved by shoulder 12 of bushing 5, rearwardly past the tapered portion 30. In this way barrel 3 works like a drive flange in that spring 11 releases tension that was previously applied to barrel. Helical or friction ring spring 14 bearing against stop bushing 6 is compressed through retaining ring 13. Spring 14 is so dimensioned that the barrel motion is reversed and starts to move forward in the direction of arrow V before studs 7 butt against the left ends of slots 9, as seen in FIG. 1 (see points U1 in FIG. 7).

The forward or counter recoil motion of barrel 3 in the direction V is caused by the expansion of spring 14. This counter recoil motion is again reversed, at a point U2 (see FIG. 7), by the buffer spring cooperating with the breech, prior to reaching a position in which tapered portion 30 would become effective. Then, due to an expansion of spring 14, barrel 3 is again moved in the rearward direction, up to point U3 where its motion is reversed and continues in the forward direction until annular spring 11 runs upon tapered portion 30 (see point U4 in FIG. 7). This strongly brakes the counter recoil motion of the barrel.

It is evident that with this intermediate braking of the counter recoil motion (points U2) by the breech and with a proper dimensioning of annular spring 11 or tapered portion 30, the counter recoil can be braked to ensure that even with varying time intervals between individual shots in a burst of fire, every next shot is still fired during the counter recoil motion. The described mounting of the barrel does not cause any bending moments which might result in oscillations of the barrel and thus affect the accuracy of firing.

During the entire sequence of firing, the barrel is securely guided in slide bushings 17 and 19.

Only after the last shot of a burst of fire, stop surface 25 butts against projection 27 of bushing 6. At that time helical or friction ring spring 14 produces a damping effect, through slots 10 which are substantially shorter than slots 9.

While a specific embodiment of the invention has been shown and described in detail to illustrate the application of the principles of the invention, it will be understood that the invention may be embodied otherwise without departing from such principles.

What is claimed is:

1. A recoil and counter recoil device for a firearm which can fire a plurality of shots in succession, the firearm having a barrel movable in a recoil and counter recoil direction in a receiver, and a breech movable with and with respect to the barrel, comprising:

a recoil spring coaxial with the barrel bearing between the barrel and the receiver for absorbing motion in the barrel in the recoil direction and then moving the barrel in a counter recoil direction;

an annular spring axially fixed to the barrel and radially deformable to absorb a load;

the receiver having a tapered surface portion over which said annular spring is movable when the barrel moves in the counter recoil direction to counteract the effect of said recoil spring;

said tapered surface portion being positioned in the receiver to engage said annular spring during an end period of the counter recoil movement of the barrel.

2. A device according to claim 1, wherein said annular spring comprises a split ring spring.

3. A device according to claim 1, wherein said recoil spring comprises a helical compression spring.

4. A recoil and counter recoil device for a firearm which can fire a plurality of shots in succession, the firearm having a barrel movable in a recoil and counter recoil direction in a receiver, and a breech movable with and with respect to the barrel, comprising:

a recoil spring coaxial with the barrel bearing between the barrel and the receiver for absorbing motion in the barrel in the recoil direction and then moving the barrel in a counter recoil direction;

an annular spring axially fixed to the barrel and radially deformable to absorb a load;

the receiver having a tapered surface portion over which said annular spring is movable when the barrel moves in the counter recoil direction to counteract the effect of said recoil spring;

a bushing axially fixed to the barrel at least during the recoil motion of the barrel, said annular spring positioned between said bushing and said recoil spring; and a second bushing fixed in the receiver at least in the recoil direction, said recoil spring bearing against said second bushing;

said second bushing being displaceable in the counter recoil direction agains said recoil spring.

5. A device according to claim 4, including a stop projection on said first mentioned bushing for locking the movement of the barrel with movement of said first mentioned bushing in the recoil direction and a projection on said second bushing for locking the movement of the barrel to movement of said second bushing in the counter recoil direction.

6. A device according to claim 5, wherein said first mentioned and second bushing include at least one elongated slot each and a stud connected to the receiver projecting into each of said elongated slots for permitting movement of said first mentioned bushing through the recoil and counter recoil movements and said second bushing through at least a part of the counter recoil movement.

* * * * *